US010094132B2

(12) United States Patent
Lymberis

(10) Patent No.: US 10,094,132 B2
(45) Date of Patent: Oct. 9, 2018

(54) TECHNIQUES FOR PROTECTION OF STRUCTURES FROM WIND AND EARTHQUAKE TYPE STRESSES

(71) Applicant: Ioannis Lymberis, Ios (GR)

(72) Inventor: Ioannis Lymberis, Ios (GR)

( * ) Notice: Subject to any disclaimer, the term of this patent is extended or adjusted under 35 U.S.C. 154(b) by 9 days.

(21) Appl. No.: 15/377,055

(22) Filed: Dec. 13, 2016

(65) Prior Publication Data

US 2017/0089089 A1 Mar. 30, 2017

Related U.S. Application Data

(63) Continuation of application No. 12/866,894, filed as application No. PCT/GR2009/000009 on Feb. 5, 2009, now Pat. No. 9,540,783.

(30) Foreign Application Priority Data

Feb. 14, 2008 (GR) ..... 080100105

(51) Int. Cl.

| | |
|---|---|
| ***E02D 5/80*** | (2006.01) |
| ***E02D 7/28*** | (2006.01) |
| ***E04H 9/02*** | (2006.01) |
| ***E04B 1/98*** | (2006.01) |
| ***E04H 9/14*** | (2006.01) |

(Continued)

(52) U.S. Cl.

CPC ..... *E04H 9/021* (2013.01); *E02D 5/80* (2013.01); *E04B 1/22* (2013.01); *E04B 1/98* (2013.01); *E04C 5/08* (2013.01); *E04H 9/14* (2013.01); *E02D 5/803* (2013.01); *E02D 7/28* (2013.01)

(58) Field of Classification Search

CPC ... E04H 9/021; E04H 9/14; E04B 1/98; E04C 5/08; E02D 5/80; E02D 5/801; E02D 5/574; E02D 5/803; E02D 7/28

See application file for complete search history.

(56) References Cited

U.S. PATENT DOCUMENTS 3,555,751 A * 1/1971 Thorgusen ..... E02D 19/04 249/40
3,881,288 A * 5/1975 Fay ..... F16B 5/0642 29/452

(Continued)

*Primary Examiner* — Phi D A

(74) *Attorney, Agent, or Firm* — George C. Pappas

(57) ABSTRACT

The tie rod for structural projects for the protection of structures for earthquake and wind is comprised of a cast iron base (7) which has a bolt (4) passing through a hole, which is surrounded by threaded ring (5) with handles (6). A base plate (2) that sits on the bolt and turns with a ball bearing. A steel cable (9) passes through all; the one end of the cable is fixed to the base (2) with bolts (3). The other end leads to a member with blades around it (10), (12), (13), (14) which open and close around the member (17) with the help of bars (11) connected around the axis of the member with pins. To the other end, they are connected with pins to the blades. The rod presses the structure to the ground by a bolt connected to a cable which pulls a member (17) with blades which open against the sides of a hole drilled on the ground and pull the building towards the ground decreasing torque created by the forces of an earthquake or the wind. It is used on buildings with a frame, continuous building, wood frame houses with storm problems, cable bridges, loose ground slopes, etc.

20 Claims, 4 Drawing Sheets

(51) Int. Cl.
*E04B 1/22* (2006.01)
*E04C 5/08* (2006.01)

(56) References Cited

U.S. PATENT DOCUMENTS 4,235,055 A * 11/1980 Schambeck ..... E01D 19/14 52/223.13
4,258,518 A * 3/1981 Xercavins ..... F16G 11/05 52/223.13
4,484,425 A * 11/1984 Muller ..... E01D 19/14 14/22
4,899,497 A * 2/1990 Madl, Jr. ..... E04B 1/0007 52/126.6
5,826,387 A * 10/1998 Henderson ..... E02D 27/42 405/249
5,904,447 A * 5/1999 Sutton ..... B09C 1/00 175/323
6,634,830 B1 * 10/2003 Marshall ..... E02D 5/30 403/368
7,059,091 B2 * 6/2006 Paulshus ..... B63B 21/502 52/223.13
7,070,362 B2 * 7/2006 Rasmussen ..... E02D 5/44 405/232
7,707,797 B2 * 5/2010 Henderson ..... E02D 27/42 405/232
7,967,532 B2 * 6/2011 Schmidt ..... E02D 5/805 405/259.1
8,104,242 B1 * 1/2012 Fouad ..... E04C 3/34 52/223.14
2002/0078643 A1 * 6/2002 Belbeoc'h ..... E04C 5/12 52/223.13
2003/0115810 A1 * 6/2003 Reinert, Sr. ..... E02D 5/803 52/156
2004/0065030 A1 * 4/2004 Zambelli ..... E04B 1/21 52/223.13
2008/0034682 A1 * 2/2008 Carpenter ..... E02D 5/74 52/155
2014/0250806 A1 * 9/2014 Schibsbye ..... E02D 27/42 52/223.13

* cited by examiner

TECHNIQUES FOR PROTECTION OF STRUCTURES FROM WIND AND EARTHQUAKE TYPE STRESSES

CROSS-REFERENCE TO RELATED APPLICATIONS

This application is a continuation of pending application Ser. No. 12/866,894, filed on May 14, 2012, which is a National Stage Application of WO2009101454, filed on Feb. 5, 2009, which claims priority to Greek Patent Application 20080100105, filed on Feb. 14, 2008.

This application is also related to commonly-owned co-pending application Ser. No. 15/377,085, filed on same date herewith, which is also a continuation of pending application Ser. No. 12/866,894.

All the applications herein mentioned are commonly owned and assigned to the Applicant of the present application.

BACKGROUND

Technical Field

The present disclosure relates to a tie rod for structural projects, which ensures protection of structures from wind and earthquake.

Background Information

Up to now, the efforts of structural sciences were focused on antiseismic protection of buildings and their protection from the wind.

Efforts are focused on improvement of the ground, improvement of construction materials and improvement of concrete and iron under the American and German structural regulation. All these are good for structures but they lack a basic element. And that is that structures are not glued to the ground and therefore they can move during an earthquake, they can break and they can fall because of the wind. With the side forces applied by an earthquake or the wind the building is raised from the one side and tilts towards the other.

This means that the front sections of the building that are tilted cannot carry the weight of the back side of the building and support the whole weight. The result is that girders are caused to break and the building collapses. The other problem is that concrete that is used as the main structural material in the construction of frames cannot withstand the tension even though it withstands compression well.

Therefore, as the back side of the building is raised, strong tension and torque forces are formed which result in collapse. In frame buildings, torque depends on two other forces: tension and compression. During an earthquake, on multiple-story buildings the last slab, the middle one and the first one suffer different torque forces and forces in the shape of an 'S' are applied on the building, which are reverse and opposite to one another. There is a staged resonance increase of these forces and the building collapses.

This invention aims to the maximum and even zero minimization of these problems so that structures do not collapse.

SUMMARY

Figure 1:
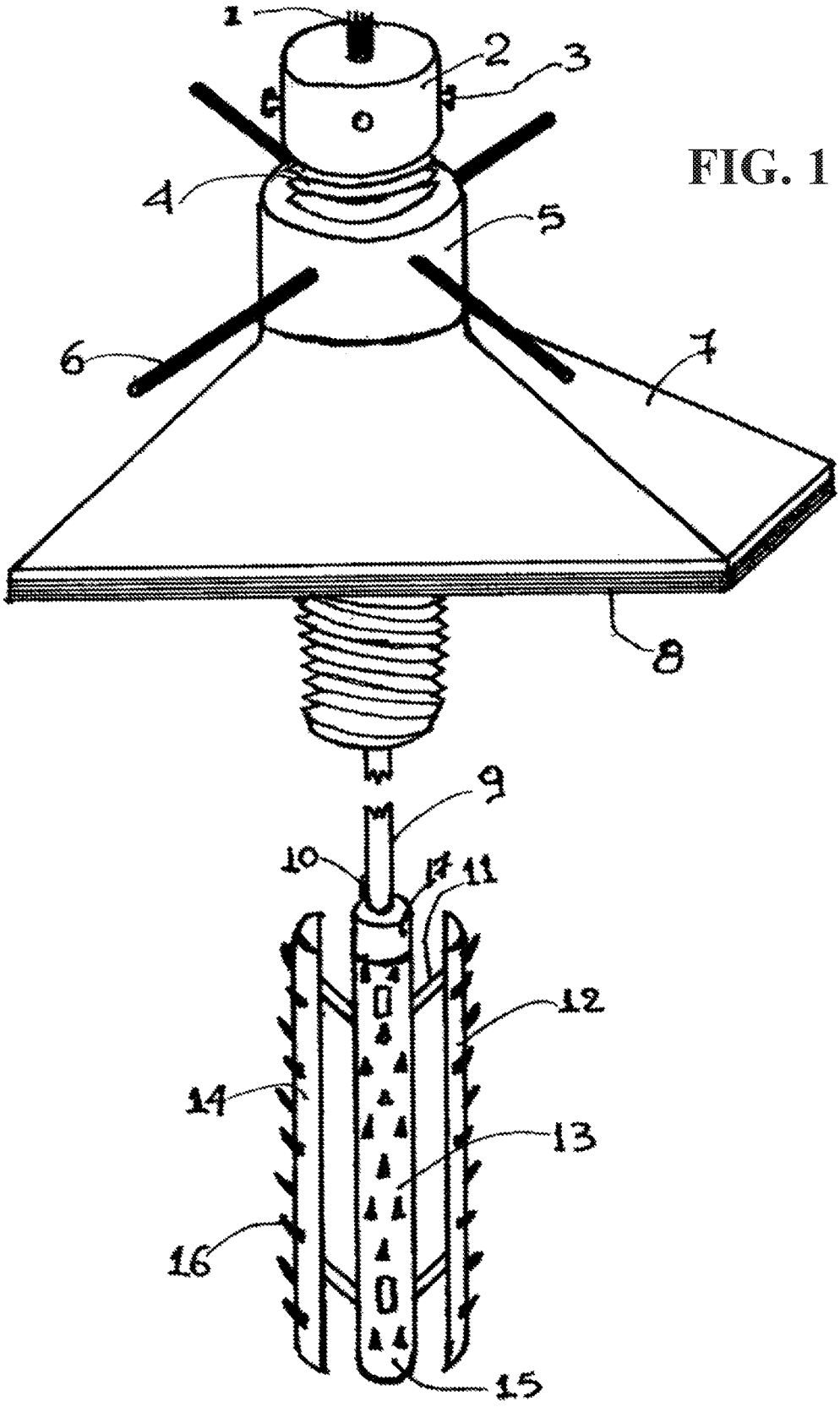
FIG. 1 is a tie rod constructed in accordance with an exemplary embodiment.
Figure 2:
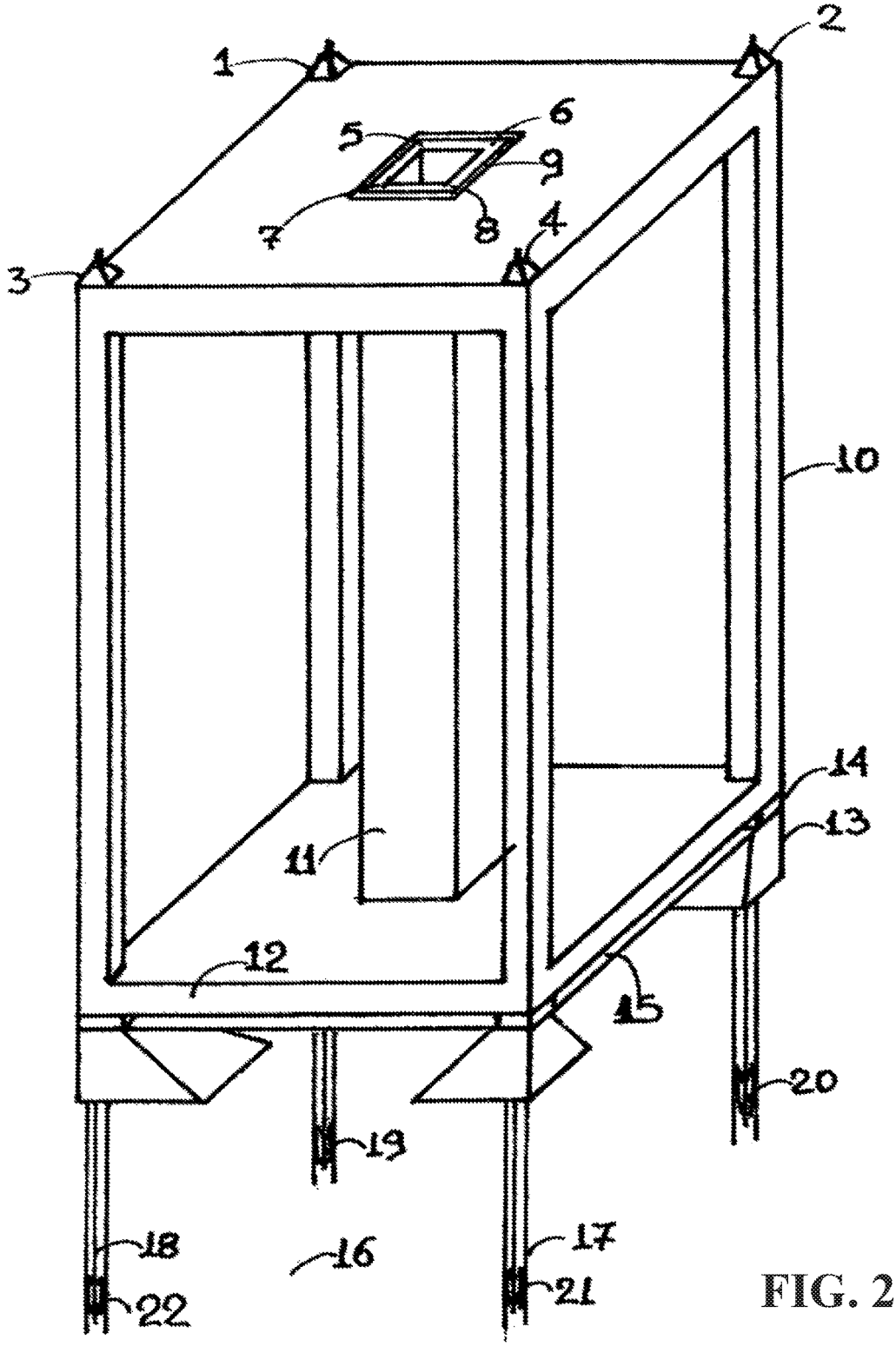
FIG. 2 shows a building with multiple tie rods disposed in accordance with an exemplary embodiment.
Figure 3:
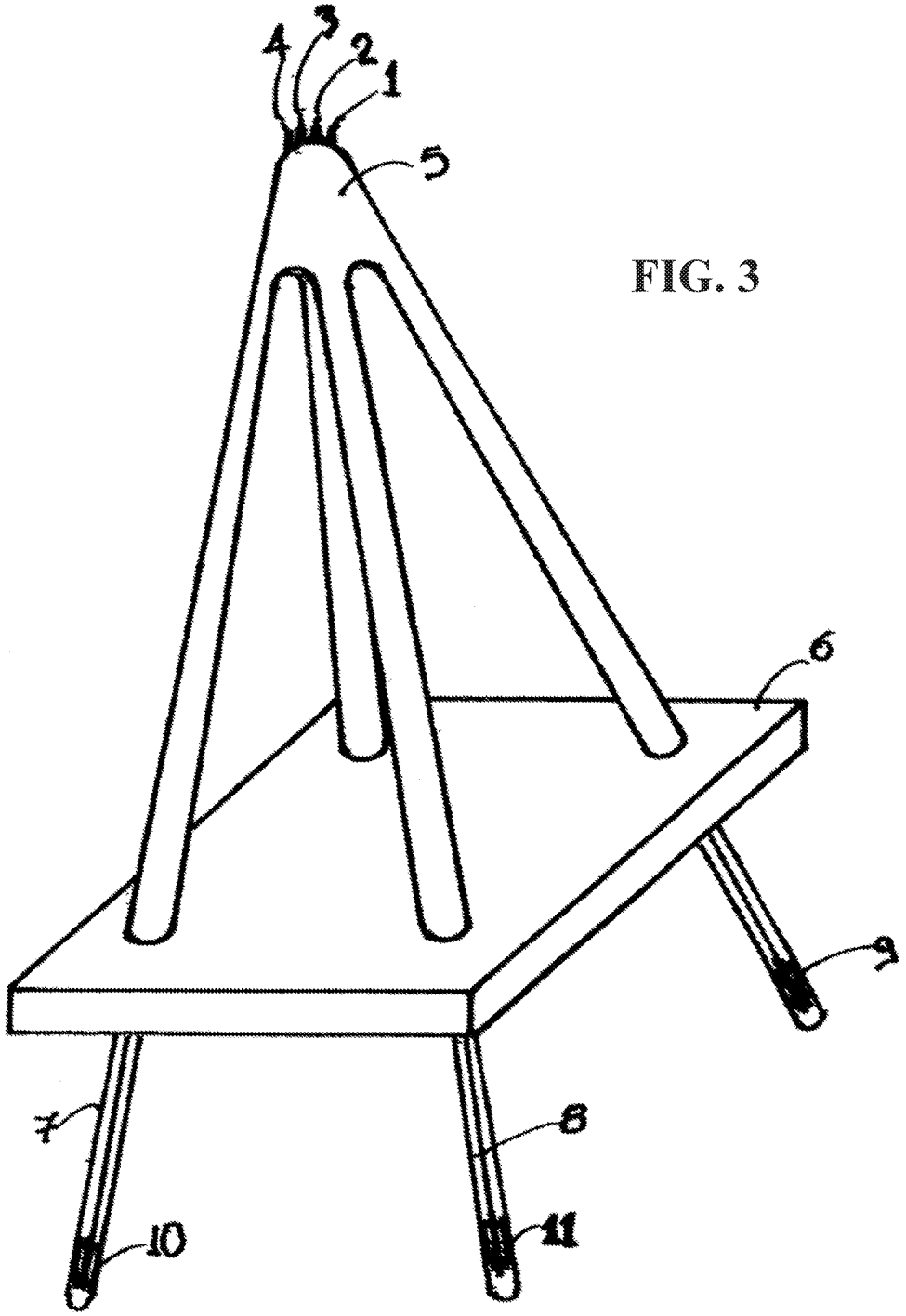
FIG. 3 shows pylons of a suspended cable bridge fixed to the ground using tie rods in accordance with an alternate exemplary embodiment.
Figure 4:
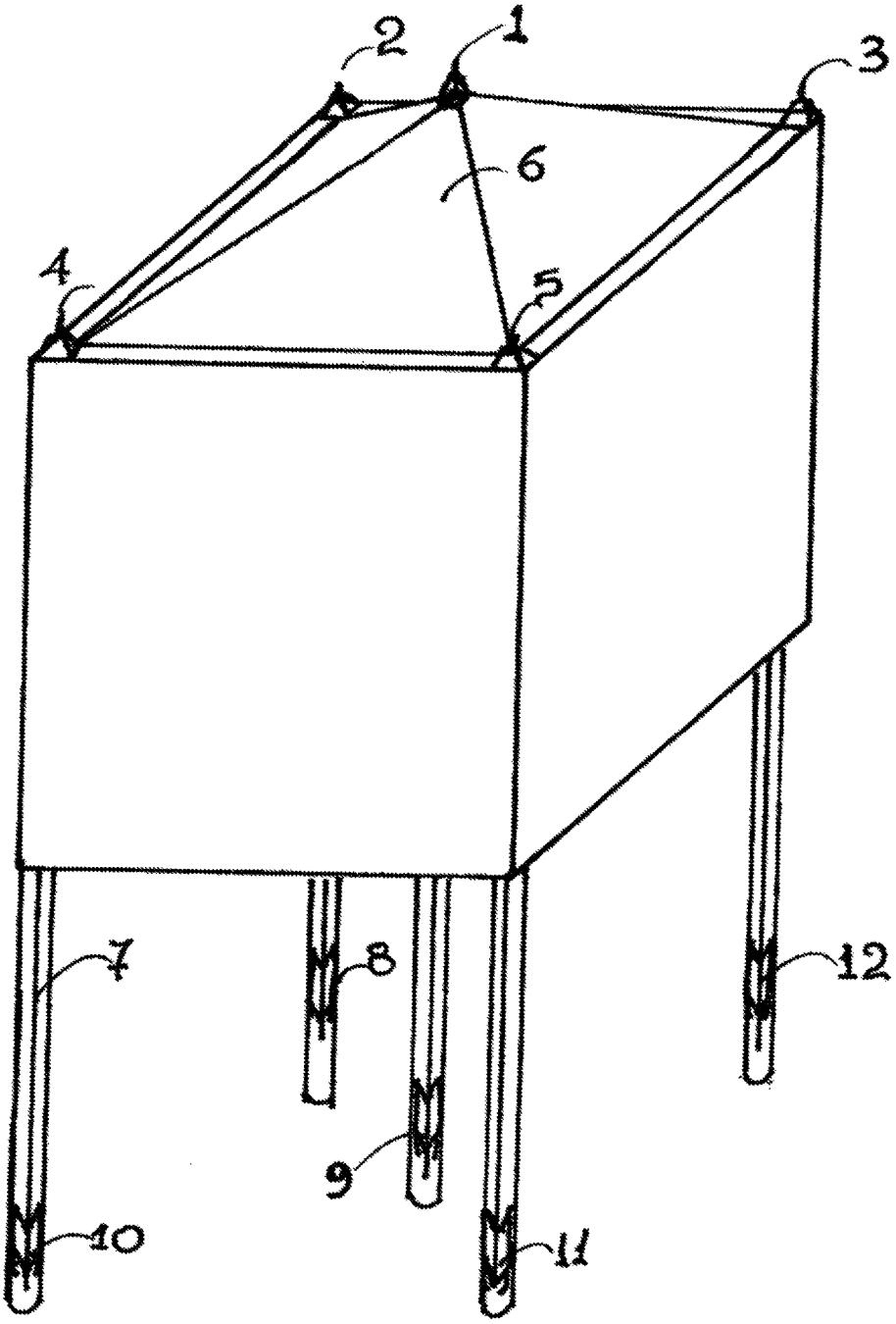
FIG. 4 shows a home made of wood construction fixed to the ground using tie rods in accordance with yet a further exemplary embodiment.

According to the invention: this is achieved by applying a prestress force. Prestress is achieved by applying a tensioning force on the building performed from the top of the column to the ground. The tie rod for structural projects undertakes to apply this tensioning force on vertical support elements. Thus, we fix the whole building on the ground. In order to achieve this pull we must first drill holes at the main construction points, such as the bed plates of the frame.

Later we plunge the tie rod with the help of a steel cable connected to its end. By pulling the cable upwards, a mechanism opens the blades of the tie rod and therefore the one side is fixed to the ground. The other side we pass through a plastic pipe so that the cable does get not fixed when the concrete is poured.

When construction of the frame is finished, we connect the protruding cable to the tensioning bolt. As we turn the bolt a compression force is exerted towards the ground since the other end of the cable is fixed to the ground. The result is that the bed plates get fixed to the ground. In this way, during an earthquake or side wind forces the bed plates do not jump up or move. And thus, the reason they usually break is avoided. Second, the concrete tensioning strength is increased due to the compression applied on the column by the tie rod. And thus, the second reason that columns break is avoided. Third, if the construction has a single base, which is supported on rubber on individual bed plates and the help of the tie rod, then the building has a vertical micro-movement and at an axis equal to the ground surface with no change on the building's horizontal axis. Because the change in the shape of the straight line of the vertical and horizontal axis of the building and change of the vertical 90° relation of the two axis are responsible for the dual forces and tensions that cause buildings to collapse: and the construction relation above is decreased. The rubber between the single base and the individual bed plates contribute against shocks and absorb ground movement as well as the impact of columns on the ground.

Various objects, features, aspects and advantages of the present invention will become more apparent from the following detailed description of preferred embodiments of the invention, along with the accompanying drawings in which like numerals represent like components.

DETAILED DESCRIPTION

The word "exemplary" is used herein to mean "serving as an example, instance, or illustration." Any embodiment described herein as "exemplary" is not necessarily to be construed as preferred or advantageous over other embodiments. It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms "a", "an" and "the" include both singular and plural referents, unless the context clearly dictates otherwise. Thus, for example, "an apparatus" or "a device" includes one apparatus or device as well as plural apparatuses or devices.

The following description is intended to convey a thorough understanding of the embodiments described by providing a number of specific embodiments and details involving methods and systems for managing content submission and publication of content. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending upon specific design and other needs.

The invention is described below with the use of an example and reference to the attached designs:

Design 1 shows a 3-D rendition of the tie rod, its top and bottom part connected with a cable.

Design 2 shows the frame of a building with bed plates (13) and an elevator (11).

For the construction of a concrete frame with tie rods, we follow this procedure: we level the ground horizontally. We drill holes at the location of the columns to be constructed, right on the center of their placement on the existing construction, design 2. Drill holes must be perpendicular to the horizontal building axis. The depth of the holes must be ½ the building height. The diameter of the holes must be larger by ⅓ of the tie rod diameter (15). We plunge the tie rod (15) with the help of a cable (9) inside the hole. The tie rod and the cable size varies according to the size of the project. We repeat plunging of the other tie rods in the other locations and leave a length of cable protruding out of them.

In all cases, during pouring of concrete we pass the cable through a plastic pipe so that we can later pull it. We also pay attention that the plastic pipes are placed at the center of the column and are vertical before they are covered with the concrete. After the frame is constructed (10), we pull the cable (18) with the help of a bolt (3). As we pull, the blades of the tie rod (22) open and exert a force on the sides of the hole with the help of bars (11). These blades are equipped with pointed ends (13), design 1, for better grip on the ground. Since during an earthquake the ground creates a wave shaped impact, there is a danger that girders and slabs will break. This can be avoided in two ways. We construct the single base because during an earthquake the columns are maintained on the same horizontal or slightly slanted axis of the bed plates (design 2).

The second way is only one single base. But in this case, the tie rods are not placed on the columns but on the corners of the elevator (design 2) on locations (5), (6), (7) and (8) and pull on the elevator. It would be good if it is located in the center of the building. We pay attention to leave an elastic contraction joint (9) with enough tolerance so that the building can shake around it so as not to break but maintains its axis on a straight line.

Other points where the tie rod can be applied we find in design 3, where the pylons of a suspended cable bridge are fixed to the ground for antiseismic and wind protection reasons. In design 4, we see the wood construction of a home fixed to the ground for protection from tornado winds. Even if we suppose in design 4 that the structure is made of bricks and we place the tie rods in points (1), (2), (3), (4) and (5), we increase its seismic strength. The tie rods can also be used for shoring up loose ground with the help of an iron net.

The structural tie rod is comprised of a stainless steel member (17) which has eight stainless steel bars (11) which are connected to the member on the one end with a pin and on the other end the bars are connected to four blades located on the perimeter of the member (12), (13), (14), (10) in design 1. The exterior side of the blades is covered with pointed edges (13) which aid the blades to grip. The extension of the member is comprised of a steel cable (9) with a rubber jacket for protection from rust. This cable is fixed inside the member. Its length extends along the whole length of the hole drilled and along height of the whole building.

At its other end, it passes through the hole of a bolt (4), design 1, and comes out of the hole. The bolt (4) passes through a cast iron base plate (7) and moves vertically up-and-down on the base with the help of a threaded ring (5) with the same threading as the bolt and touches the top of the base plate (7). This threaded ring has four turning handles (6) for screwing. The bolt (4) has a base plate at its top (2) with a hole (1) so the steel cable can pass through it (9). The base plate has bolts along its perimeter at a different height in order to achieve fixing of the cable.

This base plate (2) ensures turning of the threaded ring (5) without turning of the cable (9) because it sits on the bolt (4) with and exterior ball bearing. As the threaded ring turns (5), the bolt (4) rises and as the cable is fixed, it rises with the resistance. As it rises, it pulls the member (17). Then, the bars open (11) around the member (17) forcing the blades against the sides of the hole.

Since the diameter of the opened tie rod is greater than the hole drilled, it presses the blades and the pointed edges, it grips and causes the cable to rise. Then, the whole system presses the structure towards the ground with the help of the cast iron base plate (7).

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method of constructing a structure to prevent structural damage where the structure is characterized by at least one tie rod assembly used to set the tension of at least one vertical structural column of the structure, each tie rod assembly being comprised of a cable, a tensioning bolt system, and an anchor configured with blades that open against the sides of a hole drilled on the ground to pull the structure towards the ground in the presence of increased tensile stresses due to high winds or torque forces brought on by seismic events in the ground, the method comprising:

for each tied rod assembly, connecting one end of the cable to an anchor placed in the ground below a base of a vertical structural column and an opposite end of the cable to a tensioning bolt system located at a top surface of the vertical structural column; and tightening the tie rod at the tensioning bolt system to pull the cable and cause the blades on the anchor to fixedly secure the anchor in position into the ground without connecting the anchor of the tie rod assembly to the base of the vertical structural column.

2. The method of claim 1, where the structure comprises multiple vertical structural columns each having a corresponding tie rod assembly.

3. The method of claim 1, wherein the cable extends through a pipe material that runs the length of the vertical structural column.

4. The method of claim 3, further comprising pouring concrete around the pipe to form the vertical structural column before tightening the tie rod.

5. The method of claim 4, further comprising forming a bed plate onto which the vertical structural column is to sit, the bed plate having an appropriately sized hole to allow the cable to extend from the anchor through the bed plate and into the pipe around which concrete is to be poured.

6. The method of claim 5, wherein the bed plate is formed on shock absorbing material.

7. The method of claim 4, wherein the tensioning bolt system includes a bolt, the tightening comprising turning the bolt to exert a compression force against the ground to which the cable extends and connects to the anchor in the ground.

8. The method of claim 1, wherein the tensioning bolt system includes a bolt, the tightening comprising turning the bolt to exert a compression force against the ground to which the cable extends and connects to the anchor in the ground.

9. The method of claim 1, wherein cable thickness is a function of desired anti-seismic and wind type protection.

10. The method of claim 1, wherein the structure is at least one of a building and a bridge and comprises a plurality of vertical structural columns at least a subset of which include a tie rod assembly to couple the top of the structure via an associated tensioning bolt system to the ground via corresponding anchors and cables.

11. The method of claim 10, wherein each cable extends through a pipe material that runs the length of the corresponding vertical structural columns.

12. The method of claim 1, wherein the structure is a shaft in a building, the method further comprising securing pipes in place that traverse the vertical length of the shaft, the pipes being sized to fit cable that connects, at one end, to an anchor in the ground below a base of the building on which the shaft lays, the cable extending through the length of the pipes to protrude from an uppermost pipe at an upper surface of the building where it is connected to a common tensioning bolt system configured to pull the cable from the anchor and pre- or post-stress the shaft.

13. The method of claim 12, wherein the shaft consists of four corners, the method further comprising running four sets of pipes vertically along the corners of the shaft and connecting the cables protruding at the upper surface to a common tensioning bolt system.

14. The method of claim 12, wherein the shaft is an elevator shaft and the pre- or post-stressing of the corners of the elevator shaft creates an elastic contraction joint at each corner.

15. The method of claim 12, wherein cable thickness is a function of desired anti-seismic and wind type protection.

16. A method of pre-stressing a suspension bridge to prevent structural damage using cable that extends within the pylons of the bridge, comprising:

setting an anchor in the ground below each pylon and extending cable to run from an anchor end through and along the vertical length of the pylon in a manner which prevents the cable from becoming fixed in position, the anchor being configured with blades that open against the sides of a hole drilled on the ground to pull the structure towards the ground in the presence of increased tensile stresses due to high winds or torque forces brought on seismic events in the ground; and connecting a protruding end of each cable, at a point at an upper surface of the bridge where the pylons converge, on to either a common tensioning bolt system or to a corresponding tensioning bolt system.

17. The method of claim 16, wherein each pylon includes pipe material through which the cable is passed.

18. The method of claim 16, wherein the common tensioning bolt system includes a bolt, the method further comprising turning the bolt to exert a compression force against the ground to which the cable extends and connects to the anchor in the ground.

19. A method of pre-stressing a wood or brick framed building to prevent structural damage using sets of cables that extend vertically along associated columns of the building, comprising:

setting an anchor in the ground below each column and extending cable to run from an anchor end through and along the vertical length of the respective column in a manner that prevents the cable from becoming fixed in position, the anchor being configured with blades that open against the sides of a hole drilled on the ground to pull the structure towards the ground in the presence of increased tensile stresses due to high winds or torque forces brought on seismic events in the ground; and connecting a protruding end of each cable above each column, at an upper surface of the building, to either a common tensioning bolt system or to a corresponding tensioning bolt system.

20. The method of claim 19, further comprising connecting the anchors to an iron net to shore up loose ground.

* * * * *